United States Patent [19]

Lyons

[11] 4,145,843

[45] Mar. 27, 1979

[54] SUPPORT MEMBER FOR HATCH-COVER LIFT CYLINDERS

[76] Inventor: Robert J. Lyons, 1060 Ridge Rd., Hamden, Conn. 06514

[21] Appl. No.: 900,343

[22] Filed: Apr. 27, 1978

[51] Int. Cl.[2] ..... E05F 1/10

[52] U.S. Cl. ..... 49/386

[58] Field of Search ..... 48/386, 379

[56] References Cited

U.S. PATENT DOCUMENTS

| | | | |
|---|---|---|---|
| 933,070 | 9/1909 | Gleason | 49/386 X |
| 2,686,340 | 8/1954 | Shepard et al. | 49/386 |
| 3,561,162 | 2/1971 | Goldman | 49/386 |

*Primary Examiner*—Kenneth Downey

*Attorney, Agent, or Firm*—St. Onge, Steward, Johnston, Reens & Noe

[57] ABSTRACT

A cup-shaped support member for a lift-cylinder in a horizontal door structure, such as a hatchway, in which the lift-cylinder counter-balances the weight of the door. The base of the lift-cylinder is pressed against the bottom of the cup by its spring in the usual manner, and tilts about a flange on the foot as the door is swung open or closed. One or more clean-out holes are provided in the cup bottom, and an inturned lip is formed on the edge of the cup so that it overlaps the flange on the foot of the lift-cylinder. Foreign matter, such as dirt or ice, which heretofore has built-up under the foot of the lift-cylinder until the foot of the cylinder is lifted out of the cup, is forced through the clean-out holes in the support cup by engagement of the lip with the flange on the cylinder foot, preventing it from being lifted off the bottom of the cup while still allowing the cylinder to tilt freely.

4 Claims, 4 Drawing Figures

SUPPORT MEMBER FOR HATCH-COVER LIFT CYLINDERS

BACKGROUND OF THE INVENTION

The invention relates to door structures or hatches for roofs, sidewalks and the like, in which the door frame is disposed horizontally or at an angle to the vertical, so that the weight of the door tends to close it. More particularly the invention relates to support members for spring-actuated cylinders which lift the door toward its open position, counter-balancing the weight of the door.

It is common practice to provide doors of this type with one or more lift-cylinders which are mounted near the hinges, each cylinder being loosely received at its lower end in a straight-walled socket member fixed to the door frame, the cylinder being pivotally attached at its upper end to the door. The lift cylinder pushes upward on the door with sufficient force to counter-balance the weight of the door, the base or foot of the cylinder being pressed against the bottom of the socket member with equal force. Due to the fact that the cylinder tilts back and forth about one edge of its base plate each time the door opens and closes, dirt and other foreign matter accumulates under the bottom of the cylinder, so that the cylinder is eventually lifted out of the socket. As this point the cylinder slips laterally off the lip of the socket and is rendered inoperative.

It is a primary object of the present invention to provide a support member which prevents dirt from building up between the bottom of the lift-cylinder and its support member so that the foot of the cylinder cannot become disengaged from that member. Other objects and advantages of the invention will become more apparent from the description hereinafter.

SUMMARY OF THE INVENTION

The invention resides in providing a support member comprising a cup loosely receiving the lower end of the lift-cylinder, and in forming the cup with one or more clean-out holes in the bottom and an in-turned lip on its upper edge adjacent the point about which the foot of the cylinder tilts, such that the lip overlaps a flange provided on the foot of the cylinder, thereby positively preventing the flange from being lifted upward in the cup. As the foot of the cylinder rocks back and forth, any dirt or ice under it is forced through the clean-out hole or holes, instead of filling the cup and lifting the foot of the cylinder over the edge.

DETAILED DESCRIPTION OF PREFERRED EMBODIMENT OF THE INVENTION

One embodiment of the invention is shown in the accompanying drawings, wherein

Figure 1:
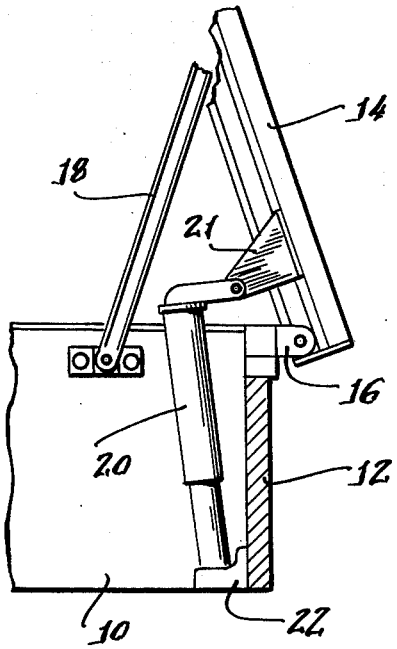
FIG. 1 is a vertical section of the hinge portion of a hatchway showing a typical counter-balancing lift-cylinder and mounting therefor, in which a supporting cup in accordance with the invention may be employed.

Referring to FIG. 1, a typical roof hatch consists of a rectangular hatchway 10, one vertical side wall 12 of which has a cover or door 14 hinged to it by means of hinges 16. Door 14 may be held in its open position by a prop 18. In order to assist in lifting the door 14 from its horizontal position when the hatch is being opened, a counter-balancing spring cylinder 20 is pivoted at its upper end to a cantilever arm 21 mounted on the underside of the door, its foot being held in a loose-fitting cup member 22, which is bolted to the vertical wall 12 of the door frame. Cylinder 20 urges door 14 upward toward its open position, while exerting an equal and opposite force downward against the bottom of support cup 22 in which it rests.

Figure 2:
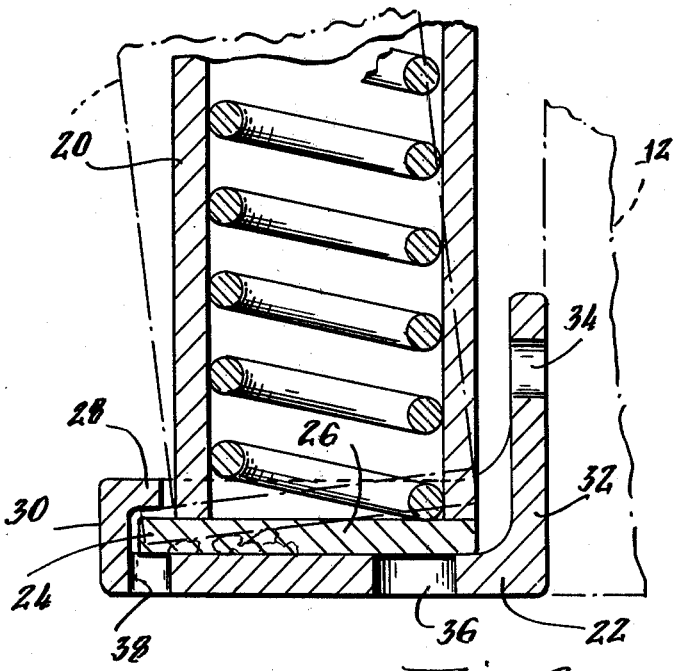
FIG. 2 is an enlarged vertical sectional view of the cup on the line 2—2 of FIG. 4 with the foot of the lift-cylinder in place.
Figure 3:
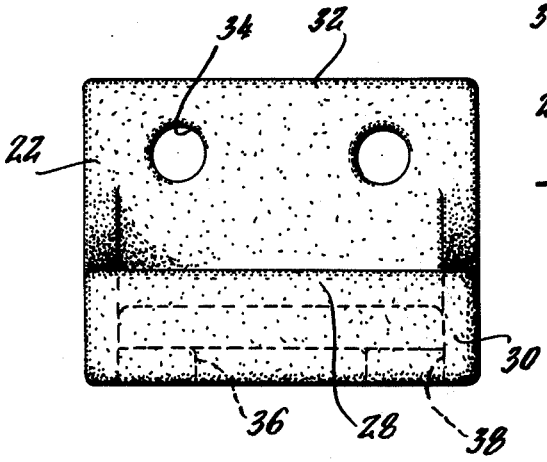
FIG. 3 is a front elevational view of the cup-member only.
Figure 4:
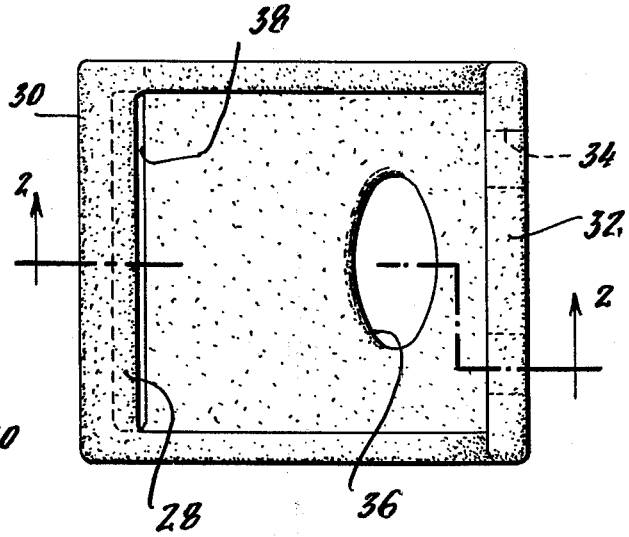
FIG. 4 is a top plan view of the cup-member.

It will be noted that due to the cantilever arm 21, the spring cylinder 20 is eccentrically loaded, so that as the door pivots open or closed it tilts slightly in its support cup 22, as illustrated in broken lines in FIG. 2. This tilting action permits dirt and ice to get under the foot of the cylinder, and in prior installations the build up of foreign material can be so extensive that the foot of the cylinder is actually lifted above the upper edge of cup 22 so that it can slip out of the cup. When this occurs the spring cylinder 20 becomes dislodged and can no longer function. Any dirt and ice between the bottom of the cup and the sole of the cylinder foot must be removed and the cylinder re-mounted in the cup by comprising its spring.

As best shown in FIG. 2, the present invention eliminates any possibility of the cylinder 20 being dislodged from its support cup 22 by foreign matter accumulating under the foot of the cylinder. To this end, a flange 24 is provided on the sole plate 26 at the foot of cylinder 20, and an in-turned lip 28 is formed on the upper edge of the adjacent wall 30 of cup 22, such that lip 28 overlaps flange 24 on the cylinder for engagement therewith.

Flange 24 and lip 28 are disposed on the side of cup 22 toward which cylinder 20 tilts as the door 14 is pivoted closed. In this instance wall 30 and lip 28 of the cup 22 are disposed opposite a back wall 32 of cup 22 which extends above the other walls of the cup so that it can be mounted by means of bolts or screws (not shown) on the wall 12 of the door frame, mounting holes 34 being provided in wall 32 for this purpose.

The bottom of cup 22 is provided in this instance with two clean-out holes 36 and 38, through which dirt, ice or other foreign matter can escape as the foot of cylinder 20 rocks back and forth during use. The large hole 36 is located toward the back of the cup at a point remote from the retaining lip 28, so that dirt trapped under the cylinder is forced rearward by the rocking action of the cylinder and then out hole 36. Hole 38 is desirably long and narrow extending substantially the full width of the cup directly under the lip 28 at a point where the outer edge of flange 24 on the cylinder rests. Consequently, any dirt or ice under the lip 28 of the cup is forced through the hole 38 by the rocking action of the sole plate 26, so that it does not build up on the cup bottom and lift the cylinder 20 out of the cup.

However, even if some dirt and ice forms under the sole plate 26 between the holes 36 and 38 in the cup 22, the flange 24 on cylinder 20 will be held down by the lip 28 on the cup so that during subsequent rocking action of the cylinder additional dirt is constantly and positively squeezed rearward toward the clean-out hole 36 due to the fact that the lip 28 holds the flange 24 down against the bottom of cup 22. It will be noted, therefore, that provision of the clean-out holes 36 and 38 by themselves is not sufficient to prevent dirt accumulation and lifting of the foot of the cylinder in its support cup. Only through the interaction of the retaining lip and at least one clean-out hole in the bottom of the support cup, is it possible to effectively overcome the build-up of ice and dirt in the cup.

What is claimed is:

1. In a door structure having a substantially horizontal frame, a door hinged to said frame for movement between a closed position and an open position, and at least one lift-cylinder for urging the door toward its open position, wherein said lift-cylinder is provided with a flanged foot plate and is supported at its foot on the frame adjacent the hinged edge of the door with its other end pivoted to the door, such that as the door is opened and closed said cylinder is rocked back and forth on its foot plate, a cup-shaped member for supporting the foot plate of said cylinder and having a bottom with surrounding side walls for loosely receiving and retaining the foot of said cylinder, a clean-out hole in the bottom of said cup member, the wall of said cup member disposed adjacent said flange on said foot plate about which said cylinder tilts having a lip turned inward of said cup member of overlapping engagement with said flange, whereby as said cylinder foot plate rocks in said cup member said overlapping engagement prevents said foot plate from being lifted out of said cup by accumulation of foreign matter therein, said rocking causing instead such foreign matter to be worked out through said clean-out hole in said cup member.

2. A cup-shaped support member for a lift-cylinder as defined in claim 1, wherein said clean-out hole is located at a point remote from said lip such that foreign matter under said foot plate is squeezed toward said clean-out hole during the rocking action of said cylinder about said flange while said flange is held in engagement with the bottom of said cup-member by said lip.

3. A cup-shaped support member for a lift-cylinder as defined in claim 2, wherein the bottom of said cup member is provided with a second clean-out hole located under said lip such that said flange forces foreign matter through said second clean-out hole during such rocking action of said cylinder.

4. A cup-shaped support member for a lift-cylinder as defined in claim 2, wherein said second clean-out hole extends substantially the full width of said cup member.

* * * * *